United States Patent [19]

Merz et al.

[11] 4,060,663

[45] Nov. 29, 1977

[54] ELECTRICAL RESISTOR GLAZE COMPOSITION AND RESISTOR

[75] Inventors: Kenneth M. Merz, Gladwyne; Howard E. Shapiro, Philadelphia, both of Pa.

[73] Assignee: TRW Inc., Cleveland, Ohio

[21] Appl. No.: 750,661

[22] Filed: Dec. 15, 1976

Related U.S. Application Data

[63] Continuation-in-part of Ser. No. 491,238, July 24, 1974, abandoned.

[51] Int. Cl.[2] ..... B32B 5/16; B32B 9/00; H01B 1/00

[52] U.S. Cl. ..... 428/428; 252/513; 252/520; 428/328; 428/325; 428/432; 428/433

[58] Field of Search ..... 428/428, 432, 433, 328, 428/325; 252/512–513, 520, 519; 427/101; 75/171

[56] References Cited

U.S. PATENT DOCUMENTS

| | | | |
|---|---|---|---|
| 2,679,568 | 5/1954 | Smith et al. | 252/513 X |
| 3,394,087 | 7/1968 | Huang et al. | 252/512 |
| 3,441,516 | 4/1969 | Mulligan et al. | 252/512 |
| 3,794,518 | 2/1974 | Howell | 428/433 X |

OTHER PUBLICATIONS

*Metals Handbook,* 8th Ed., vol. 1, Properties and Selection of Metals, American Society for Metals, Metals Park, Ohio, 1961, pp. 797–801.

*Primary Examiner*—Lorraine T. Kendell
*Attorney, Agent, or Firm*—Jacob Trachtman

[57] ABSTRACT

A vitreous enamel resistance material including a mixture of a vitreous glass frit and fine particles of a conductor which is an alloy of nickel and chromium. The conductor particles are present in the amount of 28 to 80% by weight. Up to 3% by weight of titanium and/or titanium nitride may be included in the resistance material to adjust the temperature coefficient of resistance of the material.

12 Claims, 1 Drawing Figure

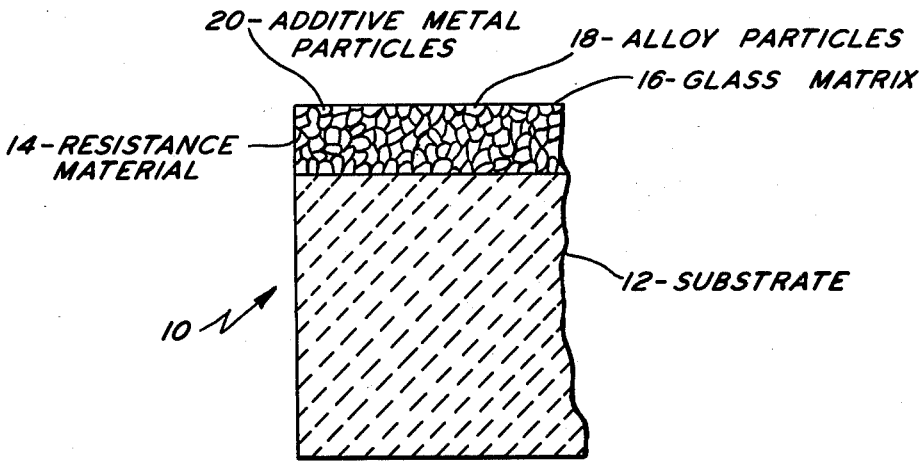
20- ADDITIVE METAL PARTICLES
18- ALLOY PARTICLES
16- GLASS MATRIX
14- RESISTANCE MATERIAL
12- SUBSTRATE
10

ELECTRICAL RESISTOR GLAZE COMPOSITION AND RESISTOR

This is a continuation-in-part of our co-pending application Ser. No. 491,238 filed July 24, 1974 and entitled Electrical Resistor Glaze Composition and Resistor, and now abandoned.

The present invention relates to a vitreous enamel resistance material and resistors made therefrom. More particularly, the present invention relates to a vitreous enamel resistance material which can be made to have a relatively low resistivity and low temperature coefficient of resistance and which has good antiflammability characteristics.

A type of resistance material which has come into substantial use is a vitreous enamel resistance material which comprises a mixture of a glass frit and fine particles of a conductive material. For many uses of this type of resistance material it is desirable to have such a resistance material which can have a low resistivity, e.g. between 2 and 20 ohms per square, and a low temperature coefficient of resistance, e.g. less than 50 parts per million per ° C (PPM/° C). Although vitreous enamel resistance materials having these characteristics have been made, they generally include a noble metal, such as gold, palladium, silver, etc., as the conductive material. Thus, such materials are relatively expensive. Therefore, it would be desirable to have a vitreous enamel resistance material which can be made with these characteristics but which does not include a noble metal so as to be less expensive. Also, another characteristic often desired for such resistance materials is good antiflammability, i.e., it will not readily burn when subjected to an overload.

It is therefore an object of the present invention to provide a novel vitreous enamel resistance material which can be made with a low resistivity and low temperature coefficient of resistance and has good antiflammability characteristics.

It is another object of the present invention to provide a vitreous enamel resistance material which includes a mixture of a glass frit and fine particles of an alloy of nickel and chromium.

It is still another object of the present invention to provide a vitreous enamel resistance material which includes a mixture of a glass frit and fine particles of an alloy of nickel and chromium to which is added a small amount of titanium and/or titanium nitride to adjust the temperature coefficient of resistance of the resistance material.

Other objects will appear hereinafter.

The invention accordingly comprises a composition of matter possessing the characteristics, properties, and the relation of constituents which will be exemplified in the composition hereinafter described, and the scope of the invention will be indicated in the claims.

The drawing is a cross-sectional view, on a highly exaggerated scale, of a resistor produced with the resistance material of the present invention.

The resistance material of the invention provides resistors with resistive films having low resistivities, low temperature coefficients of resistance and good antiflammability characteristics. Such resistors have also been found to be inherently highly stable by providing a maximum change in resistance of 1% during 1000 hours of load life testing at 25° C.

In general, the vitreous enamel resistance material of the present invention comprises a mixture of glass frit and fine particles of an alloy of nickel and chromium. A preferred alloy is 75% nickel, 20% chromium, 2.5% copper and 2.5% aluminum, although other alloys of nickel and chromium are usable. The conductive partucles of the alloy are present in the mixture in the amount of 28% to 80% by weight. In addition, the resistance material may include up to 3% by weight of fine particles 20 of titanium and/or titanium nitride to adjust the temperature coefficient of resistance of the material. The addition of titanium to the mixture shifts the temperature coefficient of resistance negative while the addition of titanium nitride shifts the temperature coefficient of resistance positive.

The glass frit used in the resistance material of the present invention may be of any well known composition which has a softening temperature below the melting temperature of the conductive particles. The glass frits most preferably used are the borosilicate frits, such as lead borosilicate frit, bismuth, cadmium, barium, calcium or other alkaline earth borosilicate frits. The preparation of such glass frits is well known and consists, for example, in melting together the constituents, of the glass in the form of the oxides of the constituents, and pouring such molten composition into water to form the frit. The batch ingredients may, of course, be any compound that will yield the desired oxides under the usual conditions of frit production. For example, boric oxide will be obtained from boric acid, silicon dioxide will be produced from flint, barium oxide will be produced from barium carbonate, etc. The glass is preferably milled in a ball-mill with water to reduce the particle size of the frit and to obtain a frit with particles of substantially uniform size.

The particles of the alloy of nickel and chromium can be made by atomizing molten alloy into −325 mesh powder. The titanium and titanium nitride particles used to adjust the temperature coefficient of resistance are also −325 mesh powder of these materials.

To make the resistance material of the present invention, a mixture of 70 to 80% of the conductive particles and 20 to 30% of the glass frit are ball milled together to reduce the particles size of the conductive particles to a Fisher Sub Sieve number (FSS) of about 1. The ball milling may be done wet or dry, but it is preferable to do it wet with butyl carbitol acetate. Ball milling the conductive particles with some glass frit increases the grinding rate and reduces contamination. Additional glass frit is then added to the ball milled mixture to achieve the desired proportions of the conductive particles and glass frit. The mixture is then wet milled with butyl carbitol acetate at a viscosity which is preferably of 1–3 poise to achieve a uniform mixture. The mixture is then adjusted to the proper viscosity for the desired manner of applying the resistance material to a substrate by either adding or removing the liquid medium of the material. For example, to apply the resistance material by dipping, the material is preferably adjusted to a viscosity of 1–2 poise. However, to apply the resistance material by screen printing, the milling vehicle is evaporated, and the mixture is mixed with a suitable organic binder on a roll mill.

To make a resistor with the resistance material of the present invention, the resistance material is applied to a uniform thickness on the surface of a substrate. The substrate may be a body of any material which can withstand the firing temperature of the resistance material composition. The substrate is generally a body of a ceramic, such as glass, porcelain, refractory, barium titanate, or the like. The resistance material may be applied on the substrate by brushing, dipping, spraying or screen stencil application. The substrate with the resistance material coating is then fired in a conventional furnace at a temperature at which the glass frit becomes molten, typically between 800° and 1100° C. For resistance materials of the present invention, it has been found preferable to fire the coated substrate in an inert atmosphere, such as argon, helium, nitrogen to achieve a resistor of better stability. When the coated substrate is cooled, the vitreous enamel hardens to bond the resistance material to the substrate.

As shown in the drawing, the resultant resistor of the present invention is generally designated as 10. Resistor 10 comprises the ceramic substrate 12 having a layer 14 of the resistance material of the present invention coated and fixed thereon. The resistance material layer 14 comprises the glass 16 and the finely divided particles 18 of the alloy of nickel and chromium embedded within and dispersed throughout the glass 16. Particles 20 of titanium and/or titanium nitride, may also be embedded within and dispersed throughout the glass 16.

The following examples are given to illustrate certan preferred details of the invention, it being understood that the details of the examples are not to be taken as in any way limiting the invention thereto.

EXAMPLE I

A resistance material of the present invention was made by ball milling together a mixture of 79% by weight of an alloy of 75% nickel, 20% chromium, 2.5% copper and 2.5% aluminum of a particle size of −325 mesh, and 21% by weight of an alkaline earth borosilicate (52% barium oxide, 20% baron oxide, 20% silicon dioxide, 4% aluminum oxide and 4% titanium oxide) frit with 26 parts by weight of butyl carbitol acetate to reduce the particle size of the mixture to 1-2FSS. Additional amounts of the glass frit were added to various portions of the mixture to form resistance materials having the compositions shown in Table I, and butyl carbitol acetate was added to each of the compositions to provide a milling viscosity of 0.5 to 2 poise. The compositions were each ball milled for 72 hours and then adjusted to a 1 to 2 poise dipping viscosity.

Alumina rods 0.095 inches in diameter were dipped in each of the compositions, dried and fired at 1000° C in nitrogen on a 30 minute cycle. The fired rods were sectioned into 0.35 inch long pieces. A silver coating was applied to both ends of each section and a capped lead forced over the silver coating. The resistance values and temperature coefficient of resistance of these resistors are shown in Table I.

TABLE I

| | 1 | 2 | 3 | 4 | 5 | 6 | 7 |
|---|---|---|---|---|---|---|---|
| Glass frit (wt. %) | 71.6 | 63.6 | 56.6 | 50.2 | 38.4 | 28.6 | 22.8 |
| Alloy particles (wt. %) | 27.7 | 35.2 | 42.1 | 48.4 | 59.5 | 69.0 | 76.6 |
| Mill contaminates (wt. %) | 0.8 | 1.0 | 1.2 | 1.5 | 2.1 | 2.4 | 0.7 |
| Resistance (ohms/square) | 17.0 | 7.4 | 4.8 | 2.2 | 1.8 | 2.4 | 3.0 |
| Temperature coeff. of Resistance (PPM/° C) | | | | | | | |
| +25° C to +150° C | 98 | 91 | 88 | 80 | 80 | 71 | 49 |
| +25° C to −55° C | 93 | 90 | 92 | 88 | 85 | 77 | 42 |

EXAMPLE II

A resistance material was made in the same manner as described in Example I with the resistance material having a final composition of 50.2% by weight of the alloy, 48.4% by weight of the glass frit and 1.5% by weight of mill contaminates. Resistors were made with this composition and in the same manner as described in Example I, except that different groups of the resistors were fired at different temperatures as shown in Table II. The resistance values and temperature coefficient of resistance of these resistors are shown in Table II. This shows the effect of the firing temperature on the resistance value and temperature coefficient of resistance achieved.

TABLE II

| | | | | |
|---|---|---|---|---|
| Firing temperature (° C) | 825 | 950 | 1000 | 1100 |
| Cycle time (Hrs.) | 1.0 | 1.0 | 0.5 | 0.5 |
| Resistance (ohms/square) | 23 | 16 | 2.2 | 3.2 |
| Temperature Coefficient of Resistance (PPM/° C) | | | | |
| +25° C to +150° C | 73 | 102 | 80 | 72 |
| +25° C to −55° C | 45 | 105 | 88 | 62 |

EXAMPLE III

Resistance materials were made in the manner described in Example I except that titanium and/or titanium nitride were added to the various compositions in the amounts shown in Table III. Resistors were made from these compositions in the manner described in Example I. The resistance values and temperature coefficients of resistance of these resistors are shown in Table III. This shows the effect of adding the titanium and/or titanium nitride.

TABLE III

| | 1 | 2 | 3 | 4 | 5 | 6 | 7 |
|---|---|---|---|---|---|---|---|
| Glass frit (wt. %) | 57 | 56.1 | 55.5 | 54.5 | 49.3 | 49.1 | 49.0 |
| Alloy particles (wt. %) | 42 | 40.0 | 40.1 | 37.9 | 43.4 | 43.3 | 43.1 |
| Titanium (wt. %) | 0 | 1.2 | 1.4 | 2.9 | 2.7 | 2.0 | 0 |
| Titanium nitride (wt. %) | 0 | 0 | 0 | 0 | 0 | 0.8 | 3.2 |
| Mill contaminates (wt. %) | 1 | 2.6 | 2.8 | 4.7 | 4.7 | 4.8 | 4.7 |
| Resistance (ohms/square) | 5.0 | 11.0 | 8.0 | 6.0 | 10.0 | 5.0 | 10.0 |
| Temperature coeff. of Resistance (PPM/° C) | | | | | | | |
| +25° C to 150° C | 88 | 26 | 9 | −106 | −217 | 29 | 203 |
| +25° C to −55° C | 92 | 17 | 11 | −146 | −217 | 32 | 201 |

EXAMPLE IV

Resistance materials were made in the manner described in Example I except that the alkaline earth frit shown in Table IV was used and titanium was added to the glaze composition which is shown in Table V. A group of resistors made with this resistance material was tested for flammability in the following manner: The resistors each of which had a resistance of 39 ohms and a rating of 3 watts, were subjected respectively to 4x, 8x, 16x and 32x rated power. A resistor was acceptable if it opened without flaming or if it flamed with a flame having a maximum height of 1 inch, and lasting less than one second, and did not eject material capable of starting a fire. Each of the resistors tested passed the flammability test without producing a flame.

TABLE IV

| | Weight Percentage |
|---|---|
| Magnesium oxide (MgO) | 10 |
| Calcium floride ($CaF_2$) | 4 |
| Calcium oxide (CaO) | 2 |
| Baron oxide ($B_2O_3$) | 28 |
| Aluminum oxide ($Al_2O_3$) | 14 |
| Silicon dioxide ($SiO_2$) | 42 |

TABLE V

| | |
|---|---|
| Glass frit (wt. %) | 41 |
| Alloy particles (wt. %) | 59 |
| Titanium (wt. %) | 0.2 |
| Resistance (ohms/square) | 2.5 |
| Temperature coeff. of Resistance (PPM/° C) | |
| +25° C to +105° C | +18 |
| +25° C to −55° C | +25 |

EXAMPLE V

A resistance material was made in the same manner as described in Example I except that the alloy was 80% nickel and 20% chromium and had a final composition of 50% by weight of the alloy and 50% by weight of the glass frit. Resistors were made with this composition in the same manner as described in Example I except that the resistors were fired at 1025° C on a 30 minute cycle. The resistors had a resistance value of 1.2 ohms per square and temperature coefficient of resistance values of 98 PPM/° C for from +25° to +150° C and 95 PPM/° C for from +25° to −55° C.

EXAMPLE VI

Resistors produced in accordance with the invention as described in Example I were subjected to a load life test and a humidity test for determining their utility.

Under the load life test the resistors were operated at 25° C with rated voltage intermittently applied for an extended period of time, and the resistance values of the resistors were measured prior to the test and at set intervals during the test to determine changes in resistance.

The resistors were subjected to the moisture test to determine their stability under high heat and humidity conditions. For this test, the resistors were cycled between the temperatures of 65° and 25° C while in high humidity. The resistance values of the resistors were measured before and after the test to determine change in resistance. The test results for the load life and moisture tests are shown in Table VI.

TABLE VI

| Test | | |
|---|---|---|
| Load Life | | |
| at 25° C | Hours | 1000 |
| | % Δ R Max. | 0.89 |
| | Min. | −0.02 |
| | Avg. | ±0.30 |
| Humidity | | |
| | Hours | 24 |
| | % Δ R Max. | 0.07 |
| | Min. | 0.00 |
| | Avg. | 0.01 |

The present invention may be embodied in other specific forms without departing from the spirit or essential attributes thereof, and, accordingly, reference should be made to the appending claims, rather than to the foregoing specifications as indicating the scope of the invention.

What we claim is:

1. A vitreous enamel resistor composition adapted to be applied to and fired on a ceramic body to form electrical resistors comprising a mixture of a glass frit and finely divided particles of an alloy of nickel and chromium, the particles of the alloy being present in the mixture in the amount of approximately 28 to 80% by weight, and said alloy containing approximately 75 to 80% by weight of nickel and approximately 20% by weight of chromium.

2. A vitreous enamel resistance material in accordance with claim 1 in which the alloy includes approximately 75% by weight of nickel and 20% by weight of chromium.

3. A vitreous enamel resistor composition in accordance with claim 2 in which the alloy also includes about 2.5% by weight of copper and about 2.5% by weight of aluminum.

4. A vitreous enamel resistor composition in accordance with claim 1 in which the mixture also includes up to about 3% by weight of titanium particles.

5. A vitreous enamel resistor composition in accordance with claim 1 in which the mixture also includes up to about 3% by weight of particles of titanium nitride.

6. A vitreous enamel resistor composition in accordance with claim 1 in which the mixture also includes a total weight of up to about 3% of particles of both titanium and titanium nitride.

7. An electrical resistor having a resistivity in the range of approximately 2 to 20 ohms per square, comprising a nonconductive ceramic body, a resistive film of glass on a surface of the body, and fine particles of an alloy containing approximately 75 to 80% by weight of nickel and approximately 20% by weight of chromium embedded within and dispersed throughout the glass film, the alloy being present in the resistive film in the amount of approximately 28 to 80% by weight.

8. An electrical resistor in accordance with claim 7 wherein the alloy includes approximately 75% by weight of nickel.

9. An electrical resistor in accordance with claim 8 wherein the alloy also includes about 2.5% by weight of copper and about 2.5% by weight of aluminum.

10. An electrical resistor in accordance with claim 7 including up to about 3% by weight of fine particles of titanium embedded in and dispersed throughout the glass film.

11. An electrical resistor in accordance with claim 7 including up to about 3% by weight of fine particles of titanium nitride embedded in and dispersed throughout the glass film.

12. An electrical resistor in accordance with claim 7 including a total weight of up to about 3% of fine particles of both titanium and titanium nitride embedded in and dispersed throughout the glass film.

* * * * *